United States Patent [19]

Weber et al.

[11] Patent Number: 5,037,705

[45] Date of Patent: Aug. 6, 1991

[54] OXYGEN-CONTAINING MOLYBDENUM METAL POWDER AND PROCESSES FOR ITS PREPARATION

[75] Inventors: Theodor A. Weber, Goslar-Jerstedt; Wolfgang Kummer, Goslar, both of Fed. Rep. of Germany

[73] Assignee: Hermann C. Starck Berlin GmbH & Co. KG, Berlin, Fed. Rep. of Germany

[21] Appl. No.: 585,802

[22] Filed: Sep. 20, 1990

Related U.S. Application Data

[62] Division of Ser. No. 427,582, Oct. 27, 1989, Pat. No. 4,976,779.

[30] Foreign Application Priority Data

Nov. 8, 1988 [DE] Fed. Rep. of Germany ..... 3837782

[51] Int. Cl.[5] ..... B22F 1/02; B22F 1/00

[52] U.S. Cl. ..... 428/570; 428/403; 428/404

[58] Field of Search ..... 428/570, 403, 404

[56] References Cited

U.S. PATENT DOCUMENTS

| | | | |
|---|---|---|---|
| 3,407,057 | 10/1968 | Timmons | 75/5 BB |
| 3,819,384 | 6/1974 | Ingham et al. | 75/5 BB |
| 3,881,911 | 5/1975 | Chaney et al. | 75/5 BB |
| 3,890,137 | 6/1975 | Beyer et al. | 75/5 BB |
| 3,907,546 | 9/1975 | Port et al. | 428/570 |
| 3,909,241 | 9/1975 | Chaney et al. | 75/5 BB |
| 3,973,948 | 8/1976 | Laferty et al. | 75/5 BB |
| 4,146,388 | 3/1979 | Lafferty et al. | 420/429 |
| 4,624,700 | 11/1986 | Port et al. | 75/363 |
| 4,684,400 | 8/1987 | Ritsko et al. | 75/363 |
| 4,758,406 | 7/1988 | Nauta et al. | 75/5 BB |

FOREIGN PATENT DOCUMENTS

| | | |
|---|---|---|
| 233574 | 8/1987 | European Pat. Off. . |
| 0233574 | 8/1987 | European Pat. Off. . |
| 2332179 | 10/1974 | Fed. Rep. of Germany . |

OTHER PUBLICATIONS

Chemical Abstracts, 95:101499m (1981).

*Primary Examiner*—R. Dean
*Assistant Examiner*—David W. Schumaker
*Attorney, Agent, or Firm*—Connolly and Hutz

[57] ABSTRACT

A molybdenum metal powder having an outer shell coating of $MoO_2$ is useful in flame spray or plasma spray processes and is prepared by partially oxidizing molybdenum powder in a carbon dioxide atmosphere at temperatures of up to 1200° C.

4 Claims, 2 Drawing Sheets

OXYGEN-CONTAINING MOLYBDENUM METAL POWDER AND PROCESSES FOR ITS PREPARATION

This is a division of application Ser. No. 427,582 filed Oct. 27, 1989, now U.S. Pat. No. 4,976,779.

The present invention relates to molybdenum metal powder with a shell of oxides of molybdenum and to processes for its preparation.

BACKGROUND OF THE INVENTION

Molybdenum metal powders with a defined oxygen content are used for plasma spraying in order to achieve particularly hard spray coatings. Molybdenum wire is preferably employed as the fusible material for flame spraying with an ethine-oxygen mixture. The metal droplets are partly oxidized during flame spraying by this procedure.

See, Gmelin Handbuch der anorganischen Cehmie, Molybdän (Gmelin Handbook of Inorganic Chemistry, Molybdenum), supplement volume part A1, 1977 pages 182 et. seq.

Although processes for the preparation of corresponding oxygen-containing molybdenum metal powder are known, in contrast to flame spraying plasma spraying has still not been able to find acceptance to date for molybdenum for various reasons, since provision of corresponding powders is not guaranteed industrially.

A process for the preparation of oxygen-containing molybdenum powder by an oxidizing plasma treatment is known from U.S. Pat. No. 4,146,388. Three processes for the preparation of oxygen-containing molybdenum spray powder are described in EP-A 233 574. These are treatment of molybdenum metal with dilute hydrogen peroxide solution, thermal treatment of molybdenum metal powder with steam under an inert gas atmosphere and the preparation of agglomerated oxygen-containing molybdenum metal powder using molybdenum oxides. The disadvantage of the molybdenum powders prepared in this way is their imprecisely defined oxygen content. These molybdenum metal powders are moreover often inhomogeneous. Futhermore, these molybdenum metal powders frequently have an $MoO_3$ content which has an adverse effect on the spraying properties of the powder.

BRIEF DESCRIPTION OF THE INVENTION

The object of the present invention is to provide a molybdenum metal powder of defined oxygen content which does not have the disadvantage described.

Surprisingly, it has now been found that these requirements are met by a molybdenum metal powder with a shell of oxides of molybdenum, the oxidic shell consisting of $MoO_2$. In a preferred embodiment, the molybdenum metal powder according to the invention has an oxygen content of 1 to 18, preferably 2 to 12 wt. %. The oxygen is present here in defined form as $MoO_2$ and is, in particular, on the surface as a homogeneous layer. This oxide layer adheres firmly to the metallic core, so that the molybdenum metal powder according to the invention has quite particular structural properties.

DETAILED DESCRIPTION

The powder grains consist of a molybdenum metal core and a uniform, continuous $MoO_2$ layer. The average diameter of the individual grains of the molybdenum metal powder is preferably 5 to 90 μm and the thickness of the $MoO_2$ shell is preferably 0.1 to 20 μm.

The surface of the partly oxidized molybdenum metal powder according to the invention shows a typical $MoO_2$ coloration. Scanning electron microscope (SCM) photographs show a scarred, continuous oxide coating, in contrast to the smooth powder surface of the starting material.

The present invention also relates to a process for the preparation of the molybdenum metal powder according to the invention. Surprisingly, this can be carried out in a very easily controllable oxidation of the molybdenum metal powder under a carbon dioxide atmosphere at unexpectedly low temperatures.

This invention thus relates to a process for the preparation of molybdenum metal powder of defined oxygen content, in which molybdenum metal powder is partly oxidized by thermal treatment in a carbon dioxide atmosphere at temperatures below 1,200° C. The partial oxidation is preferably carried out temperatures of 700°to 1,200° C.

The oxygen uptake in the molybdenum metal powder in the process according to the invention takes place exclusively with the formation of $MoO_2$, which can be demonstrated by X-ray diffraction. An equivalent amount of carbon monoxide is release during the reaction.

In the oxidation treatment according tot he invention, the weight increase of the starting powder is limited to 12 wt. %. The increase in the particle diameter of the individual molybdenum metal particles corresponds here to the oxygen uptake and the associated change in density.

As the carbon dioxide supply increases and the temperature increases, the rate of oxygen uptake increases. For the same carbon dioxide supply and the same reaction temperature, the oxygen charging of the molybdenum metal powder is inversely proportional to its surface area. The oxygen contents can be set to preselected values with great accuracy via the parameters mentioned. In a particularly preferred embodiment of the process according to the invention, the oxygen content of the molybdenum metal powder is thus set by choosing the reaction time and/or the reaction temperature and/or the carbon dioxide concentration in the gas atmosphere. This is illustrated in FIG. 1 to 3.

Figure 1:
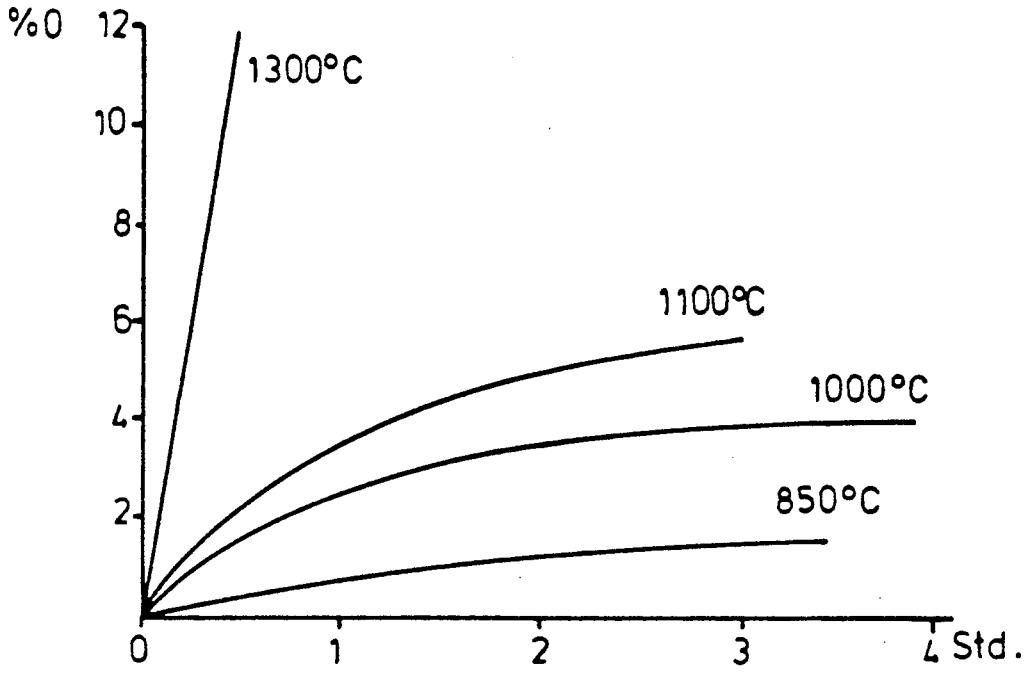
FIG. 1 illustrates the rate of oxidation for various temperatures.

FIG. 1 shows the oxygen uptake of a molybdenum metal powder as a function of the temperature and time at a constant volume flow of carbon dioxide.

Figure 2:
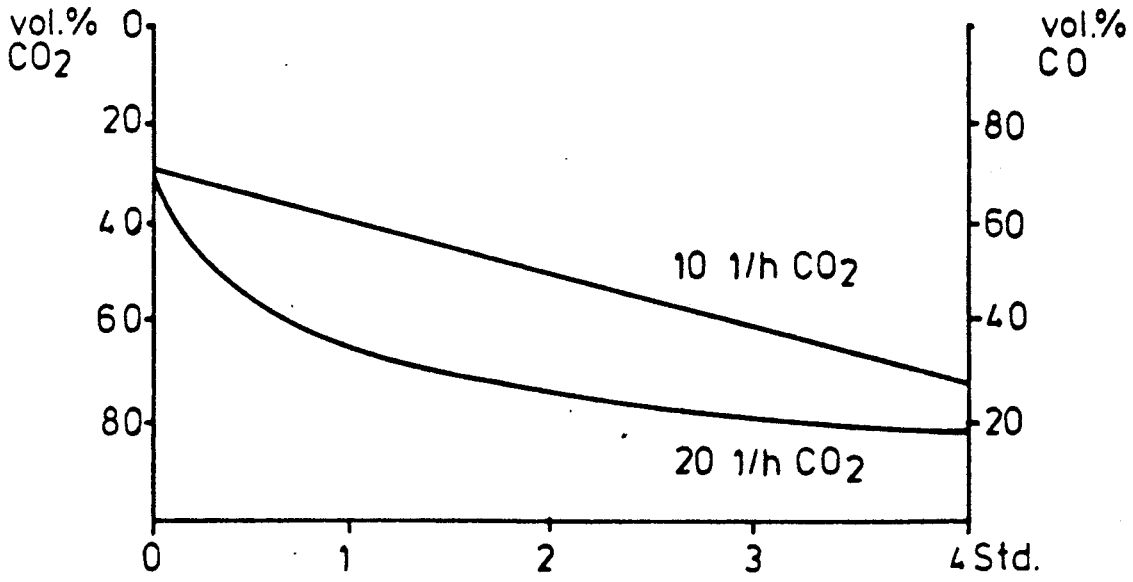
FIG. 2 illustrates the rate of oxidation on carbon dioxide volume flow.

FIG. 2 show the dependence of the oxygen uptake of a molybdenum metal powder on the carbon dioxide volume flow and the time at constant temperature, measured by the $CO_2/CO$ content in the waste gas.

Figure 3:
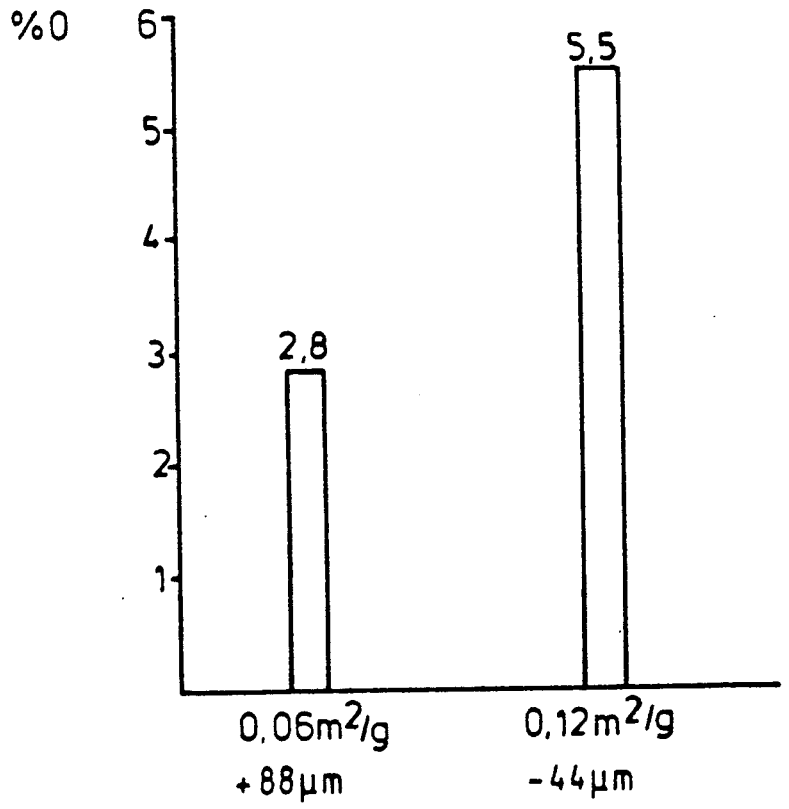
FIG. 3 illustrates the relationship of particle size to degree of oxidation.

FIG. 3 shows the dependence of the oxygen uptake of molybdenum metal powders of various particle sizes on the specific surface area of the powder at a constant carbon dioxide volume flow and constant temperature and reaction time.

An increase in the coarseness of the particles occurs due to the oxygen uptake of the molybdenum metal powder, and the density of the powder decreases.

When the molybdenum metal powders according to the invention were used in spraying experiments, a significant improvement in the hardness properties of the layers applied was found if the oxygen-doped molybdenum metal powder according to the invention was used instead of known oxide-containing molybdenum spray powders or molybdenum spray wire.

This invention thus also relates to the use of the molybdenum metal powder according to one or more of claims 1 to 6 as molybdenum spray powder.

The invention is illustrated by way of example in the following text, without a limitation thereby being considered.

EXAMPLE 800 g of a molybdenum metal powder of particle size >5 μm and <45 μm are gassed with 20 L/h carbon dioxide and heated up to 900° C. in a tubular oven.

After a reaction time of 1 hour, the oxygen content of the metal powder is 3.6 wt. %, after a reaction time of 2 hours 4.6 wt. % and after a reaction time of 3 hours 5.5 wt. %.

Some selected data of the molybdenum metal powder, which is oxidized to the extent of 3.6%, and of its starting material are given below:

| | starting material (molybdenum powder) | oxygen-containing material |
|---|---|---|
| Oxygen content | 0.19% | 3.6% |
| Density, pykn. | 10.25 g/ml | 9.49 g/ml |
| Tap density | 4.80 g/ml | 4.60 g/ml |
| Bulk density | 3.90 g/ml | 3.40 g/ml |
| Average particle size according to FSSS | 20 μm | 23 μm |

What is claimed is:

1. Molybdenum metal powder particles having a molybdenum oxide shell which consists essentially of $MoO_2$.

2. Molybdenum metal powder with an oxide shell according to claim 1 wherein the oxygen content of the powder is 1 to 18 percent by weight.

3. Molybdenum metal powder with an oxide shell according to claim 2 wherein the oxygen content is 2 to 12% by weight.

4. Molybdenum metal powder with an oxide shell according to claim 1 wherein the average particle diameter of the molybdenum metal powder is 5 to 90 μm and the thickness of the $MoO_2$ shell is 0.1 to 20 μm.

* * * * *